United States Patent [19]

Reina

[11] 3,996,677

[45] Dec. 14, 1976

[54] EXERCISE SKATE

[75] Inventor: Joseph Reina, Copiague, N.Y.

[73] Assignee: Lawrence Peska Associates, Inc., New York, N.Y. ; a part interest

[22] Filed: June 11, 1976

[21] Appl. No.: 695,252

[52] U.S. Cl. ..... 36/7.8

[51] Int. Cl.[2] ..... A43B 3/10

[58] Field of Search ..... 36/7.8, 7.5, 113; 272/96

[56] References Cited

UNITED STATES PATENTS

| | | | |
|---|---|---|---|
| 2,422,228 | 6/1947 | Ferrar | 36/7.8 |
| 2,837,840 | 6/1958 | Kerpel | 36/7.8 |
| 3,875,688 | 4/1975 | McNaughton | 36/7.8 |

*Primary Examiner*—Patrick D. Lawson
*Attorney, Agent, or Firm*—Joel Halpern

[57] ABSTRACT

An exercise skate includes a support frame having a base member and means thereon for securing the support frame detachably to a shoe. At least two threaded elements are integral with the base member and depend therefrom. An exercise element is threadedly secured to each of the threaded elements to depend therefrom. Preferably the exercise elements comprise either a coil spring with an elastomeric plug element at its lower extremity or a roller assembly.

7 Claims, 3 Drawing Figures

EXERCISE SKATE

BACKGROUND OF THE INVENTION

The present invention relates to exercise skates and more particularly to an exercise skate adapted to have various exercise elements detachably secured thereto.

Exercise skates have been known heretofore. Such skates have included a base member to which either roller assemblies, runners or spring elements have been attached. Generally the exercise element is not detachably connected to the base member so as to permit the user to select from various types of exercise elements the specific type of exercise element to be employed. Also, when the exercise element was a spring element it was customary to incorporate the spring element between a pair of plates. The exercise skate was thus not adapted to be converted to use with roller skate elements. Typical of such prior exercise skates is the device disclosed in U.S. Pat. No. 2,475,092 issued July 5, 1949 to W. B. Harrell where coil springs are mounted between an upper supporting plate and a base plate.

SUMMARY OF THE INVENTION

It is one object of the invention to provide an exercise skate which can readily be employed with exercise elements of various types.

It is another object of the invention to provide an exercise skate in which the exercise element is carried detachably by the device.

It is still another object of the invention to provide an exercise skate in which a plurality of exercise elements are carried independently and detachably by the device so as to permit replacement of individual ones of the exercise elements.

Other objects and advantages of the invention will become readily apparent from the following description of the invention.

BRIEF DESCRIPTION OF THE DRAWINGS

In order that the invention may be more fully comprehended it will now be be described, by way of example, with reference to the accompanying drawing in which.

DETAILED DESCRIPTION OF THE PREFERRED EMBODIMENT

Figure 1:
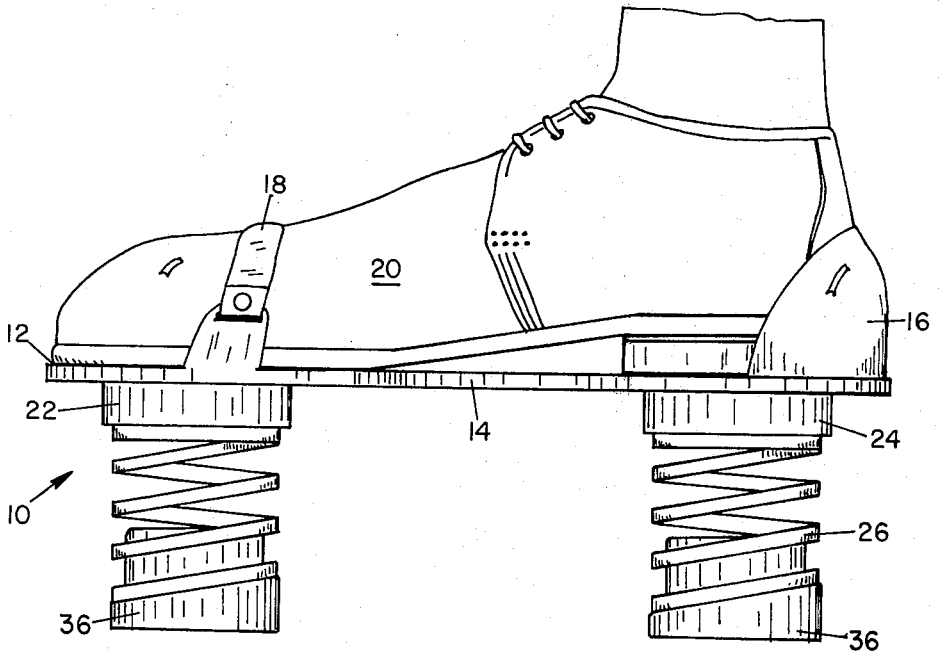
FIG. 1 is a side elevational view of an exercise skate embodying the features of the invention.

Referring to the drawings there is shown an exercise skate 10. The skate comprises a support frame 12 which may simply include a base member 14 having means thereon such as a heel bracket 16 and a strap element 18 for detachably securing the frame to a shoe 20.

The base member is elongated and is desirably made of a metal stamping. However it may be alternatively made of a synthetic plastics material and moulded to the desired shape. The base member may be provided in a range of sizes so as to fit shoes of corresponding sizes.

Depending from the base member and preferably formed integrally therewith are at least two threaded elements 22, 24. Such threaded elements are preferably in the form of internally threaded sockets adapted to receive therein respective exercise elements each having a threaded section cooperable with the threads of the threaded element to thereby detachably secure the exercise element to the support frame. In the preferred embodiment as illustrated in FIG. 1 the support frame is provided with a threaded element adjacent one end of the base member and with another adjacent the other end of the base member. In this manner a pair of exercise elements 26 may be secured to the support frame by means of threaded elements 22, 24.

Figure 2:
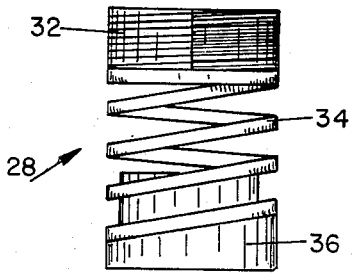
FIG. 2 is an elevational view of one form of exercise element utilizable with the exercise skate shown in FIG. 1.
Figure 3:
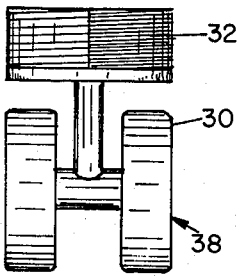
FIG. 3 is an elevational view of another type of exercise element utilizable with the exercise skate shown in FIG. 1.

As can be seen most clearly from FIGS. 2 and 3 the exercise element may take the form of either a spring assembly 28 or a roller assembly 30. In the case of the spring assembly the exercise element comprises a threaded shank 32, a coil spring 34 integrally secured to the shank and depending therefrom, and a plug element 36 secured to the lower portion of the spring. As shown the plug element caps the lower extremity of the spring and thus is adapted to engage the floor or ground when the device is in use. Desirably the plug element is made of an elastomeric material such as one of the commercially available snythetic rubbers.

As depicted in FIG. 3 the exercise element may comprise a threaded shank 32 and a wheel or roller subassembly 38 fixedly secured to the shank.

It will thus be seen that in accordance with the skate construction of the invention each of the exercise elements may be independently and detachably secured to the support frame by means of the depending threaded elements. Replacement is thus greatly facilitated, and the user can easily convert the skate from a spring-type exercise element to a roller skate.

I claim:

1. An exercise skate comprising in combination:

a support frame including a base member having means thereon for detachably securing the support frame to a shoe;

at least two threaded elements integral with said base member and depending therefrom, each of said threaded elements being adapted to threadedly and detachably receive an exercise element;

and at least two exercise elements adapted to be threadedly and detachably secured respectively to corresponding ones of said threaded elements.

2. An exercise skate according to claim 1, wherein said means for detachably securing the support frame to a shoe includes a heel bracket integral with said base member at one end thereof and at least one strap element secured to the base member adjacent the other end thereof and adapted to be secured over the toe portion of a shoe.

3. An exercise skate according to claim 1, wherein each of said threaded elements comprises a threaded socket.

4. An exercise skate according to claim 1, wherein each of said exercise elements comprises a threaded shank, a coil spring integrally secured to said shank and depending therefrom, and a plug element secured to the lower portion of said coil spring and capping the lower extremity thereof.

5. An exercise skate according to claim 4, wherein said plug element is formed of an elastomeric material.

6. An exercise skate according to claim 1, wherein each of said exercise elements comprises a threaded shank and a roller assembly fixedly secured to said shank and depending therefrom.

7. An exercise skate according to claim 1, wherein one of said threaded elements is secured to said base member adjacent one end thereof and the other of said threaded elements is secured to said base member adjacent the other end thereof.

* * * * *